US006522069B1

(12) United States Patent
Hong et al.

(10) Patent No.: US 6,522,069 B1
(45) Date of Patent: Feb. 18, 2003

(54) PLASMA DISPLAY PANEL

(75) Inventors: Dae-young Hong, Suwon (KR); Byeong-hwa Choi, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/542,474

(22) Filed: Apr. 4, 2000

(30) Foreign Application Priority Data

Aug. 5, 1999 (KR) ..... 99-32137
Aug. 30, 1999 (KR) ..... 99-36327

(51) Int. Cl.[7] ..... H01J 17/49
(52) U.S. Cl. ..... 313/582; 313/113
(58) Field of Search ..... 313/587, 581, 313/582, 583, 584, 585, 586, 113, 402, 479, 326, 239

(56) References Cited

U.S. PATENT DOCUMENTS 6,034,474 A * 3/2000 Ueoka et al. ..... 313/584
6,090,473 A * 7/2000 Yoshikawa et al. ..... 428/209
6,099,969 A * 8/2000 Ogata ..... 428/432
6,140,768 A * 10/2000 Kim ..... 313/584
6,194,833 B1 * 2/2001 DeTemple et al. ..... 313/631
6,316,110 B1 * 11/2001 Anzaki et al. ..... 428/432

FOREIGN PATENT DOCUMENTS

EP 1069815 * 1/2001 ..... H05K/9/00
JP 10117081 * 5/1998 ..... H05K/9/00
JP 11126024 * 5/1999 ..... G09F/9/00

* cited by examiner

*Primary Examiner*—Ashok Patel
(74) *Attorney, Agent, or Firm*—Leydig, Voit & Mayer, Ltd.

(57) ABSTRACT

A metal conductive film is provided on the outer surface of the rear substrate of a display panel for both shielding EM fields and helping to dissipate heat generated by the panel.

7 Claims, 3 Drawing Sheets

PLASMA DISPLAY PANEL

BACKGROUND OF THE INVENTION

1. Field of the Invention

The present invention relates to a plasma display panel (PDP), and more particularly to a means for shielding EM interference and facilitating heat dissipation.

2. Description of the Related Art

FIG. 1 is an exploded of a conventional PDP. It is generally comprised of a frame 11, a driving circuit board 12, a display panel 13 and a filter 14. The circuit 12, the display panel 13, and the filter 14 are received in an opening 15 of the frame 11. The filter is basically a glass plate coated with an electrically conductive film grounded to the frame so that electromagnetic (EM) fields generated from the panel and the circuit board are absorbed. However, such a conventional PDP has to use a rather thicker conductive film for better conductivity in order to completely shield the EM field. The downside is that increased thickness of a conductive film reduces brightness of an image displayed on the panel can not shield part of EM field that radiates toward the driving circuit board which is located at the rear of the panel, opposite to the filter. Though the casing covering the driving circuit board may prevent such backward EM radiation from escaping from the device, the circuits on the driving board are subjected to and thus can be affected by a strong EM field since it is right next to the source of the EM field.

A PDP displays an image when inert gas in selected cells defined by the front and rear substrates of the panel discharges in response to voltage signals applied to electrodes embedded in the substrates. When the PDP is in operation for a period of time, substantial heat is generated and should be dissipated outside the device so as not to cause the driving circuits to malfunction. Conventionally, an electrical fan has been provided between the driving board and the panel for circulation of air. Installing an electrical fan, however, requires a separate power source and complicates a PDP design by that much.

SUMMARY OF THE INVENTION

It is an objective of the present invention to protect electrical/electronic circuit components on the driving board of a PDP from both EM field and heat generated from the panel portion thereof.

DESCRIPTION OF THE PREFERRED EMBODIMENTS

Figure 3:
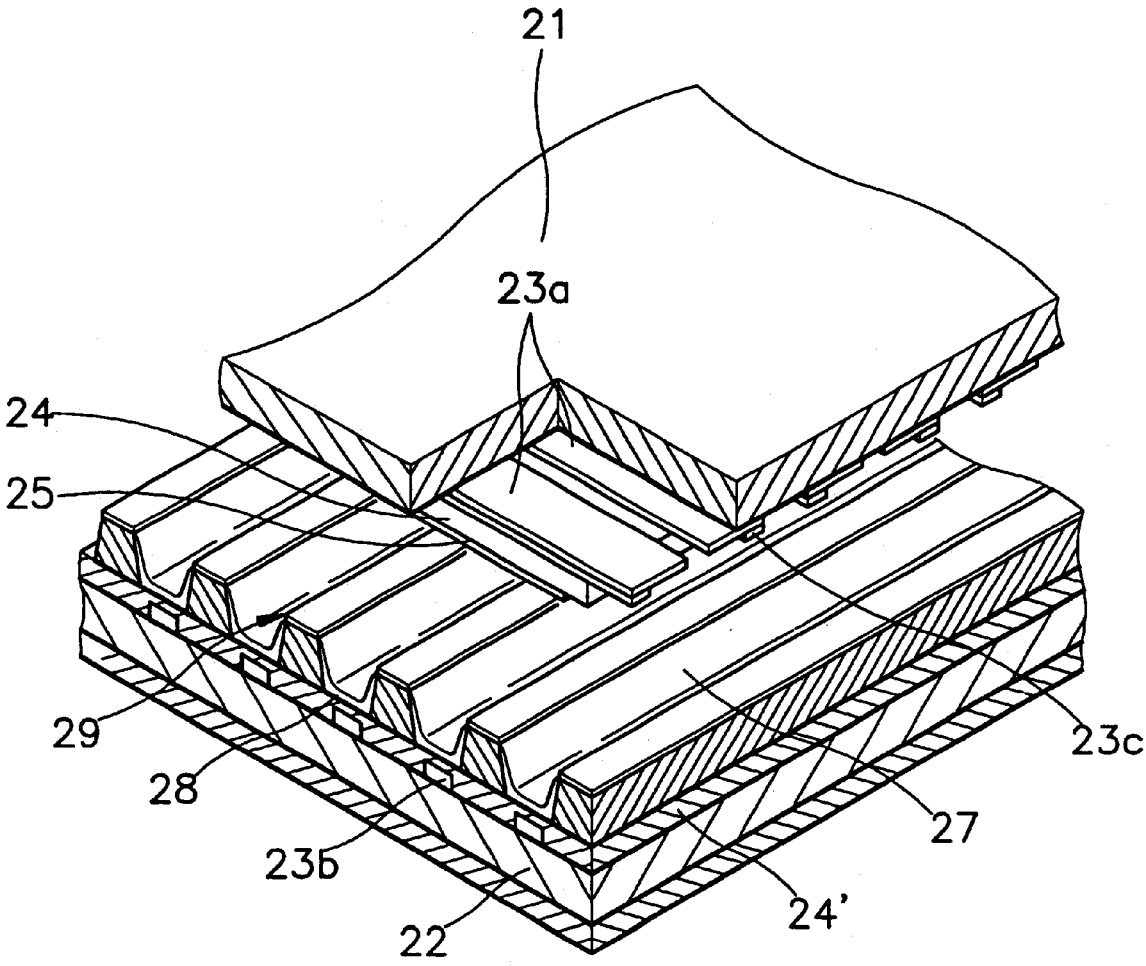
FIG. 3 is an exploded view of the panel portion of a PDP display according to the present invention.

FIG. 3 shows a plasma display panel according to the present invention. A front glass substrate 21 is spaced apart from a rear glass substrate 22. The front substrate has a plurality of pairs of display electrodes 23*a* and bus electrodes 23*c* on a surface facing the rear substrate.

Likewise, the rear substrate has a plurality of address electrodes 23*b* on a surface facing the front substrate. The front and rear substrates are disposed such that their electrodes are orthogonal to each other. On top of the display, electrodes are a dielectric layer 24 and a protective layer 25. A dielectric layer 24 is also provided on top of the address electrodes on the rear substrate. Further, a plurality of phosphor coated parallel walls 27 are erected thereupon to define cells 29. An inert gas such as argon is injected into the cells after the substrates are sealed on their periphery and evacuated. The PDP displays images when the inert gas such as argon discharges to becomes plasma in response to a high voltage difference between the electrodes, over a threshold voltage, after charges are accumulated on the cell walls by what is called a trigger voltage.

Ultraviolet light emitted during the discharge collides with the phosphor material 28 coating the walls of the cells to cause visible light emission. The characteristic feature of the present invention lies in that a conductive film is formed on the surface of the rear substrate facing the driving circuit board by such methods as vacuum deposition. The conductive film is grounded to the frame in which the panel is disposed.

This conductive film serves to absorb electromagnetic energy that is generated just as much toward the back of the panel as toward the screen side. Alternatively, a separate conductive film may be adhered to the rear surface. The EM shield may take a mesh form rather than a film.

Figure 1:
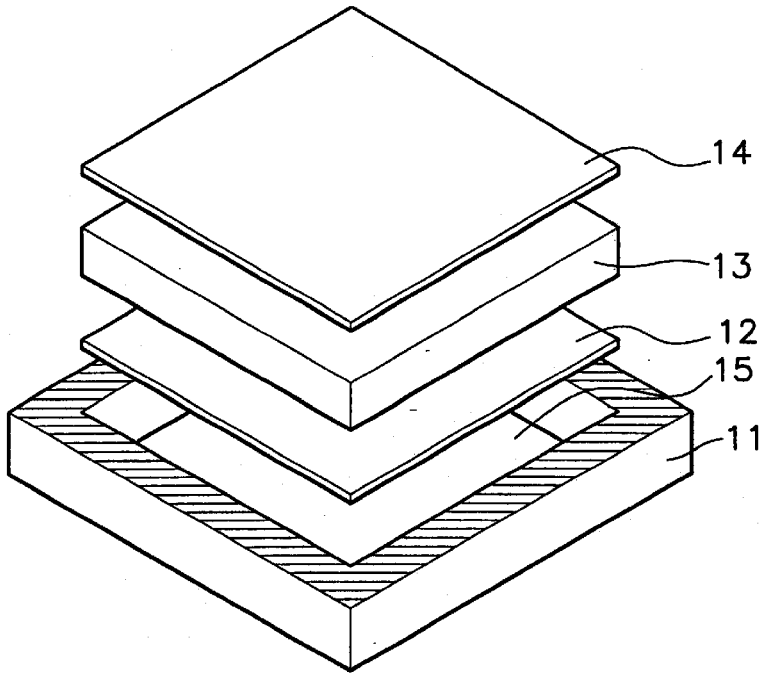
FIG. 1 (PRIOR ART)
FIG. 1 is an exploded view of a conventional PDP.
Figure 2:
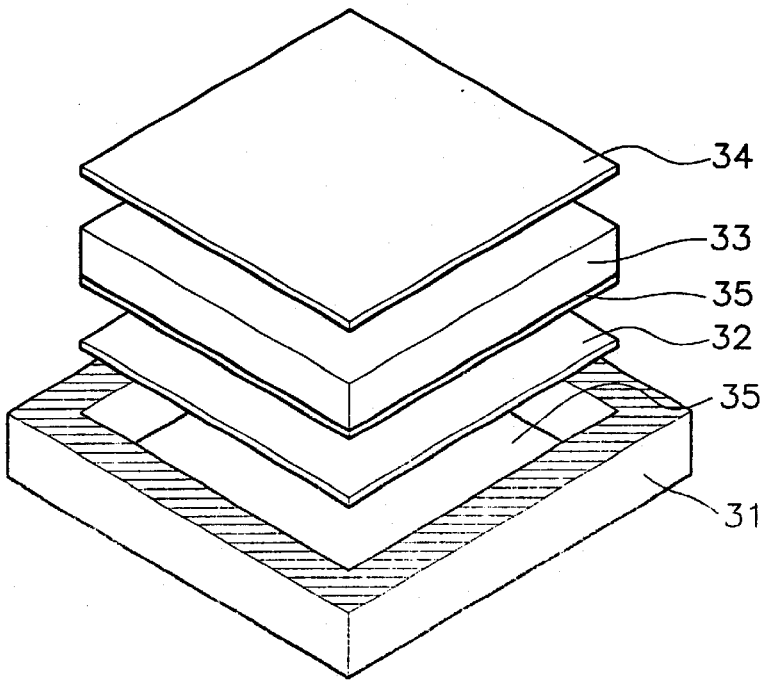
FIG. 2 is a detailed view of a PDP according to the present invention.

An embodiment of the present invention is illustrated in FIG. 2.

A driving circuit board 32 is installed within an opening 36 of a frame 31. A panel 33 is disposed over the driving circuit board 32 that is installed within the frame 31.

Additionally, a second electrically conductive EM shield 35 is provided on the rear side of the panel 33 according to the present invention. Both shields are grounded to the frame 31.

Figure 4:
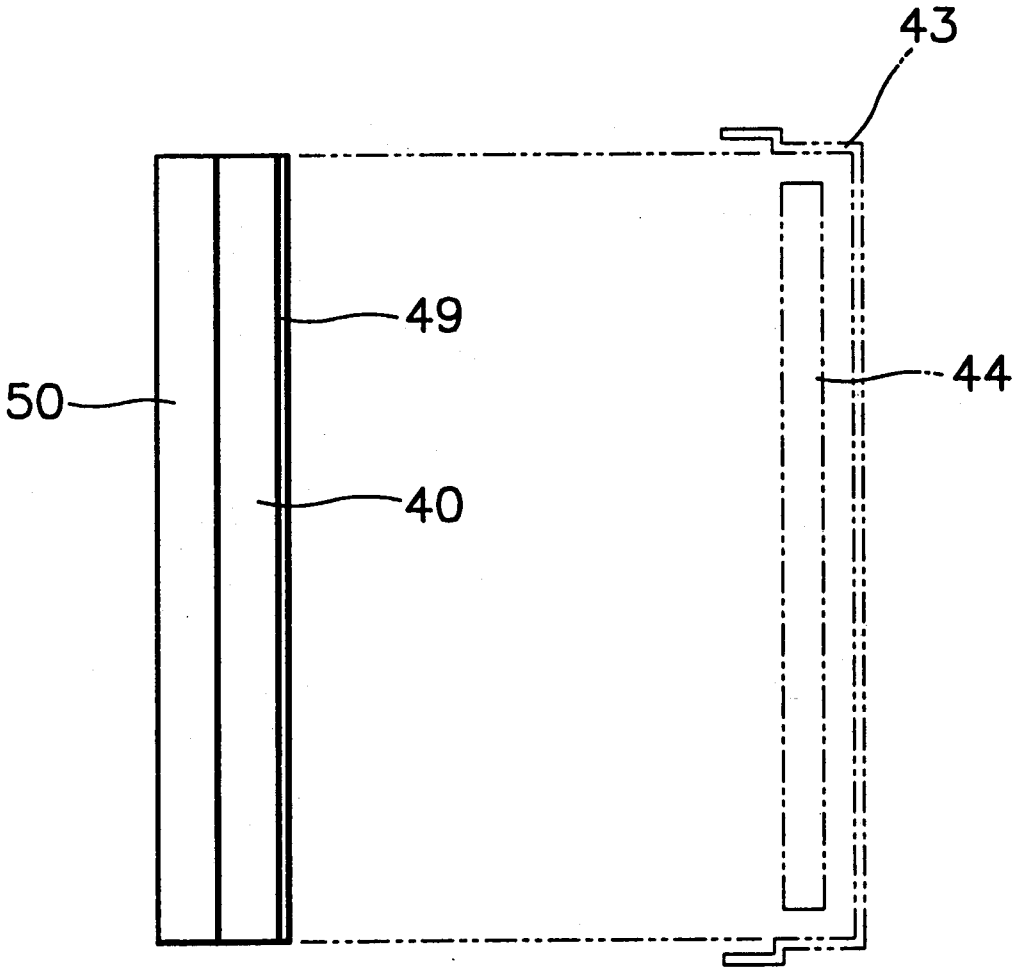
FIG. 4 is a PDP frame having a metal chassis.

According to a second embodiment of the present invention, a thermally and electrically conductive material is preferably used. Referring to FIG. 4, reference numerals 40 and 50 indicate front and rear glass substrates of the PDP display. For example, copper, aluminum or carbon compounds such as a diamond-like carbon can coat the surface of a rear glass substrate 40 in the form of a film 49. This embodiment has an additional benefit of facilitating uniform heat dissipation across the panel surface so that deformation of the front or rear glass substrate is prevented. In the embodiment shown in FIG. 4, rather than totally depending on the air as a means of heat transfer the coating layer may be connected to a metal sash 43 of the frame, which would speed up the heat transfer to outside. Furthermore, a cooling device 44 such as a water-circulating pipes or heat sinks between the conductive coating layer and the sash can be provided for better heat transfer.

What is claimed is:

1. A plasma display panel comprising:

a front substrate made of glass and through which a display of the plasma display panel is viewed;

a rear substrate made of glass and joined to said front substrate; and an electrically conductive shield for shielding electromagnetic waves, disposed on a surface of said rear substrate, facing away from said front substrate, and at ground potential.

2. The plasma display panel as claimed in claim 1, wherein said electrically conductive shield is adhered to the surface of said rear substrate.

3. The plasma display panel as claimed in claim 1, wherein said electrically conductive shield is a metal.

4. The plasma display panel as claimed in claim 3, wherein said metal is one of copper and aluminum.

5. A plasma display panel comprising:

a front substrate made of glass and through which a display of the plasma display panel is viewed;

a rear substrate made of glass and joined to said front substrate; and a shield of a diamond form of carbon for shielding electromagnetic waves, disposed on a surface of said rear substrate, facing away from said front substrate.

6. A plasma display panel comprising:

a front substrate made of glass and through which a display of the plasma display panel is viewed;

a rear substrate made of glass and joined to said front substrate;

a first electrically conductive shield for shielding electromagnetic waves, disposed on a surface of said rear substrate, facing away from said front substrate; and a second electrically conductive shield for shielding electromagnetic waves, disposed on a surface of said front substrate, facing away from said rear substrate.

7. The plasma display panel as claimed in claim 6 wherein said first and second shields are at ground potential.

* * * * *